US010874175B2

(12) United States Patent
So

(10) Patent No.: US 10,874,175 B2
(45) Date of Patent: Dec. 29, 2020

(54) DEVICE FOR ADJUSTING LENGTH OF STRING

(71) Applicant: Youn Seo So, Hwaseong-si (KR)

(72) Inventor: Youn Seo So, Hwaseong-si (KR)

( * ) Notice: Subject to any disclaimer, the term of this patent is extended or adjusted under 35 U.S.C. 154(b) by 0 days.

(21) Appl. No.: 16/470,557

(22) PCT Filed: Dec. 29, 2017

(86) PCT No.: PCT/KR2017/015768
§ 371 (c)(1),
(2) Date: Jun. 18, 2019

(87) PCT Pub. No.: WO2018/124827
PCT Pub. Date: Jul. 5, 2018

(65) Prior Publication Data

US 2019/0343235 A1 Nov. 14, 2019

(30) Foreign Application Priority Data

Dec. 30, 2016 (KR) ..... 10-2016-0183616

(51) Int. Cl.

| | |
|---|---|
| ***A43C 7/08*** | (2006.01) |
| ***A43C 11/16*** | (2006.01) |
| ***A44B 11/06*** | (2006.01) |
| ***A44B 11/12*** | (2006.01) |

(52) U.S. Cl.
CPC ..... *A43C 7/08* (2013.01); *A43C 11/165* (2013.01); *A44B 11/065* (2013.01); *A44B 11/12* (2013.01)

(58) Field of Classification Search
CPC ..... A43C 7/08; A43C 11/165; A44B 11/065; A44B 11/12
See application file for complete search history.

(56) References Cited

U.S. PATENT DOCUMENTS

| | | | | |
|---|---|---|---|---|
| 7,367,522 | B2 * | 5/2008 | Chen | A43C 7/00 24/68 SK |
| 8,235,321 | B2 * | 8/2012 | Chen | A43C 7/00 24/68 SK |
| 8,245,371 | B2 * | 8/2012 | Chen | A43C 7/00 24/68 B |

(Continued)

FOREIGN PATENT DOCUMENTS

| | | | |
|---|---|---|---|
| CN | 101843388 | A | 9/2010 |
| JP | 07-000208 | A | 1/1995 |

(Continued)

OTHER PUBLICATIONS

International Search Report for PCT/KR2017/015768 dated May 14, 2018 from Korean Intellectual Property Office.

*Primary Examiner* — Robert Sandy
*Assistant Examiner* — Louis A Mercado
(74) *Attorney, Agent, or Firm* — Revolution IP, PLLC

(57) ABSTRACT

Provided is a device having an improved structure that lowers the unit cost and failure rate of a product by reducing the number of components and improves the assemblability, consistency in quality, operational stability, and convenience of future servicing of the product. In the device, a shaft and a shaft coupling part of a winding drum are simply coupled without a separate coupling member as a protruding portion formed on the shaft becomes caught in a catching portion formed on the shaft coupling part.

4 Claims, 13 Drawing Sheets

(56) References Cited

U.S. PATENT DOCUMENTS

| | | | | |
|---|---|---|---|---|
| 9,408,438 | B2 * | 8/2016 | Chen | A43C 11/165 |
| 10,039,345 | B2 * | 8/2018 | Ha | B65H 75/4431 |
| 10,051,920 | B2 * | 8/2018 | Chen | A43C 1/00 |
| 10,264,852 | B2 * | 4/2019 | Kim | A43C 11/165 |
| 10,368,613 | B2 * | 8/2019 | Ha | A43C 7/00 |
| 10,617,546 | B2 * | 4/2020 | Turrini | A61F 5/0111 |
| 2007/0084956 | A1 | 4/2007 | Chen | |
| 2008/0196224 | A1 | 8/2008 | Hu | |
| 2014/0359981 | A1 | 12/2014 | Cotterman et al. | |
| 2016/0120267 | A1 * | 5/2016 | Burns | A44B 11/065 24/68 C |
| 2017/0295888 | A1 * | 10/2017 | Chen | A43C 11/165 |
| 2019/0343235 | A1 * | 11/2019 | So | A44B 11/065 |

FOREIGN PATENT DOCUMENTS

| | | | | |
|---|---|---|---|---|
| JP | 2016-520401 | A | 7/2016 | |
| KR | 10-0959800 | B1 | 5/2010 | |
| KR | 10-1025134 | B1 | 3/2011 | |
| KR | 10-1107372 | B1 | 1/2012 | |
| KR | 10-1147681 | B1 | 5/2012 | |
| KR | 10-2016-0021431 | A | 2/2016 | |
| KR | 10-1661233 | B1 | 9/2016 | |
| WO | 2016-033792 | A1 | 3/2016 | |
| WO | WO-2016033792 | A1 * | 3/2016 | A43C 11/165 |

* cited by examiner

[FIG. 1]
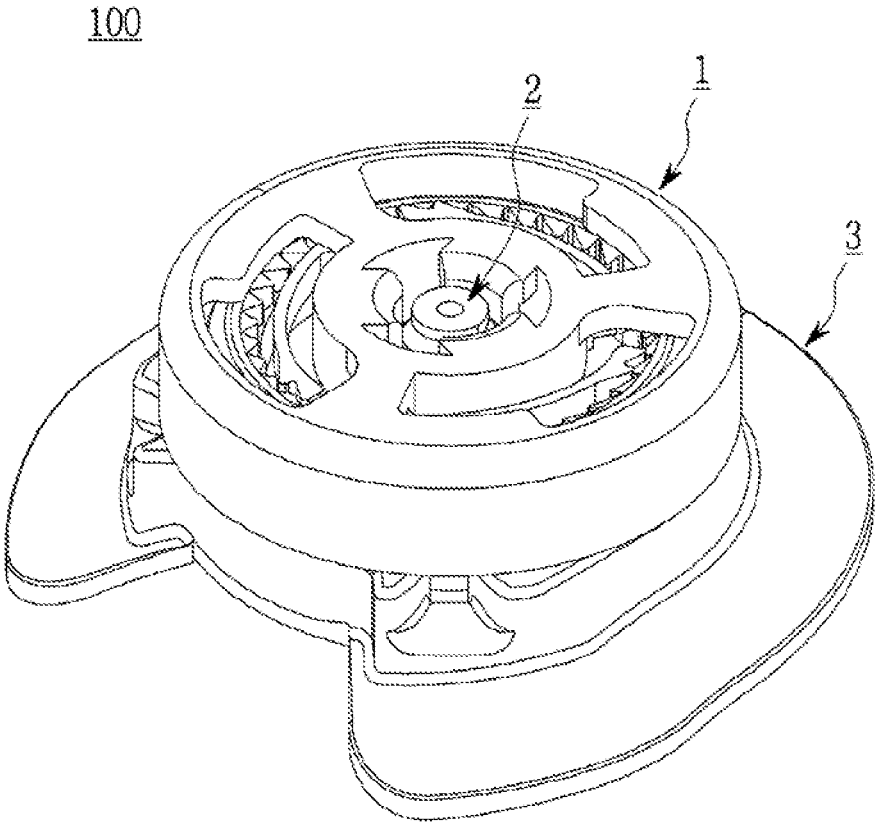

[FIG. 2]
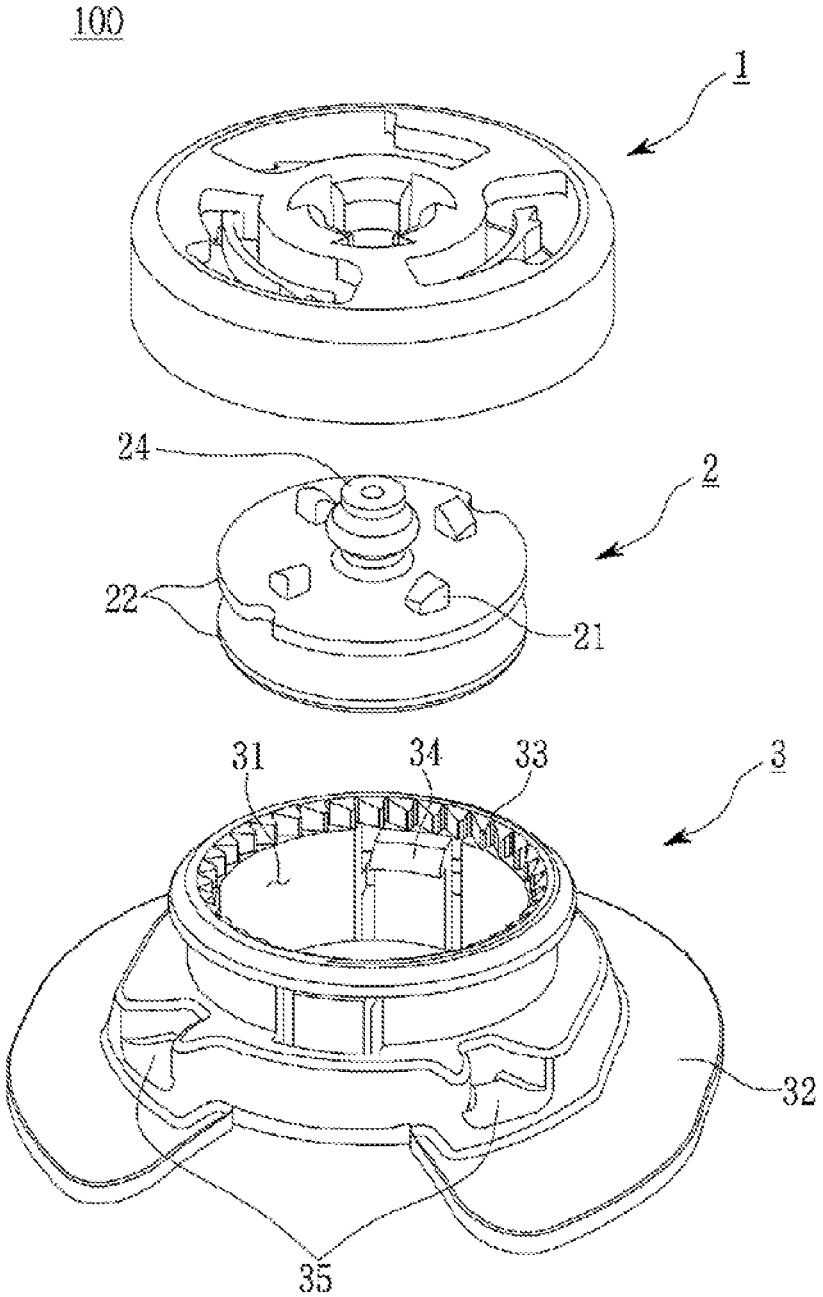

[FIG. 3]
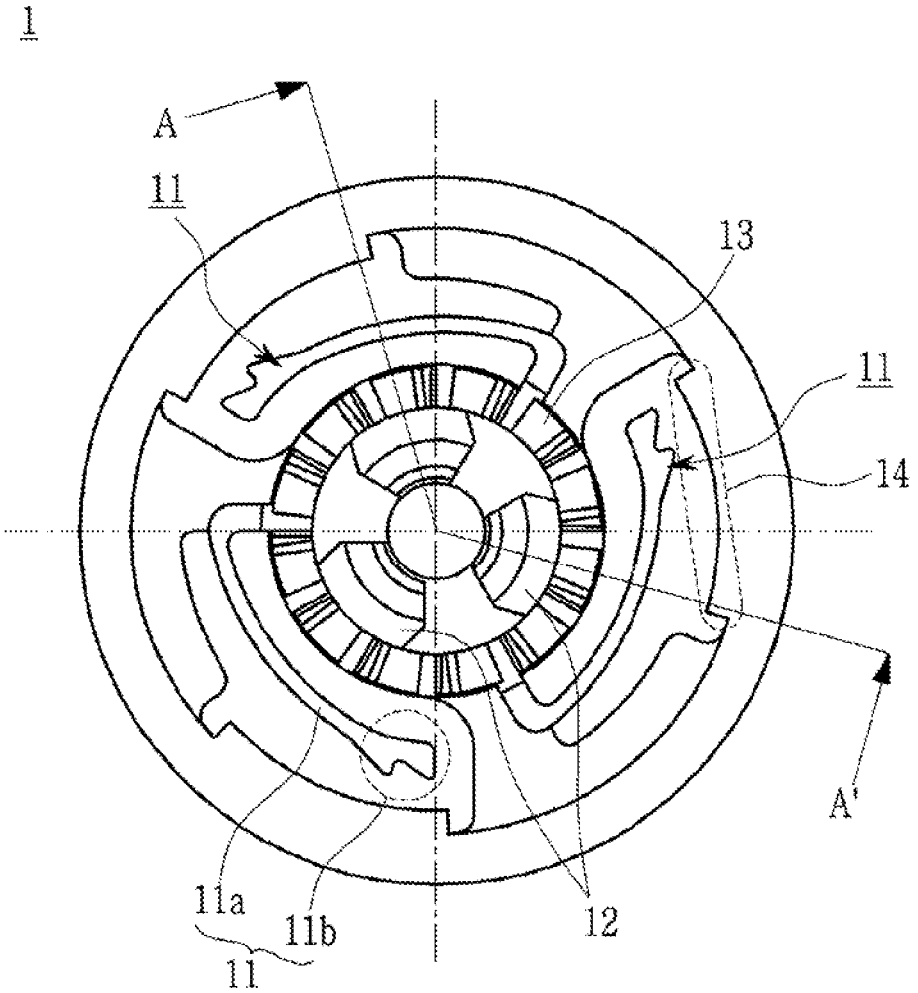
[FIG. 4]
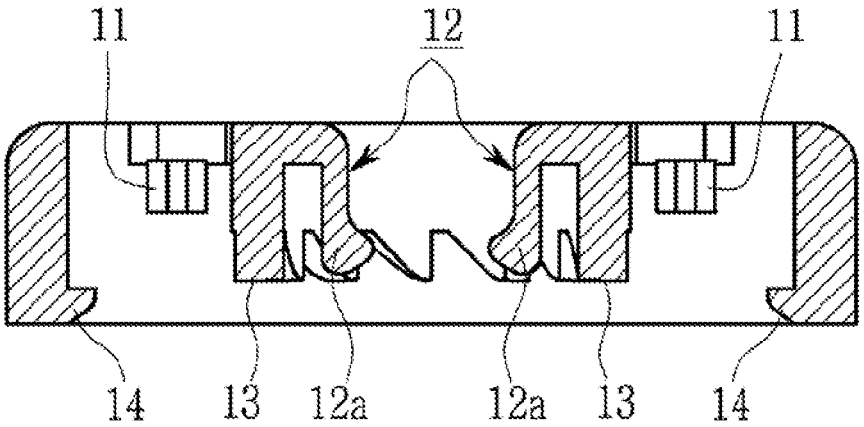

[FIG. 5]
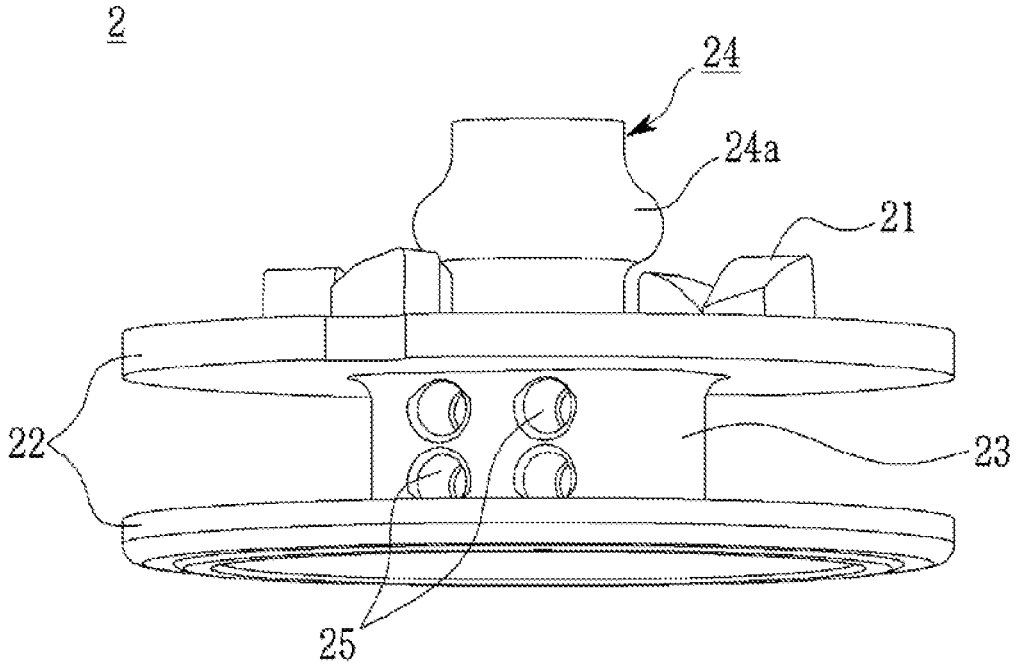
[FIG. 6]
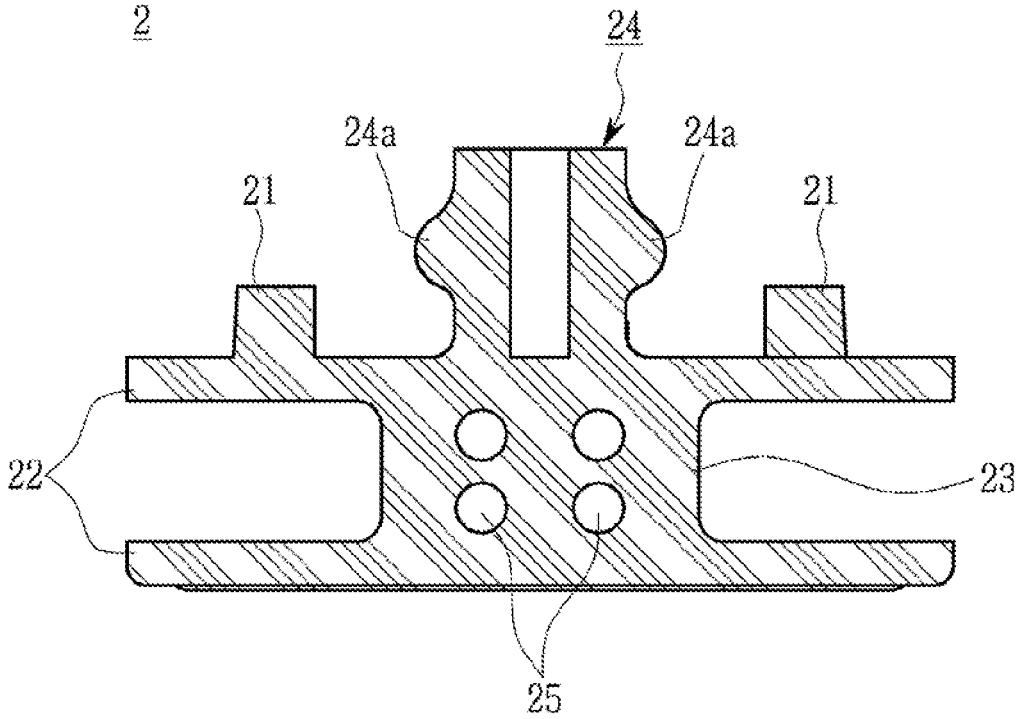

[FIG. 7]
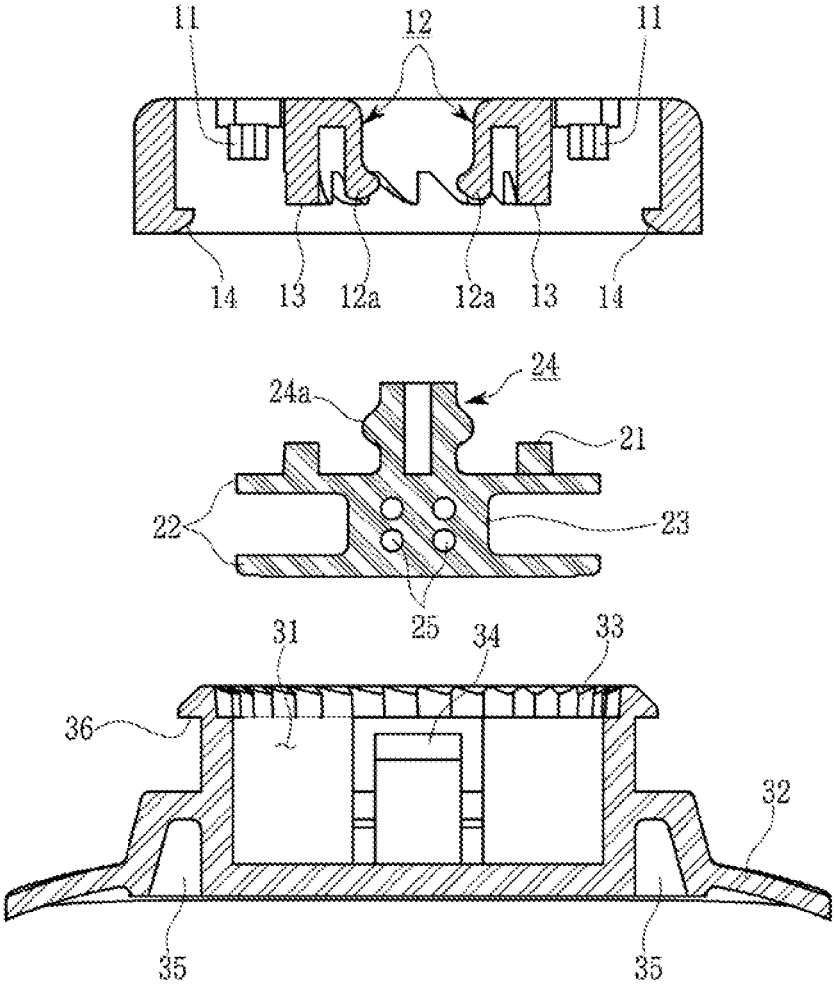
[FIG. 8]
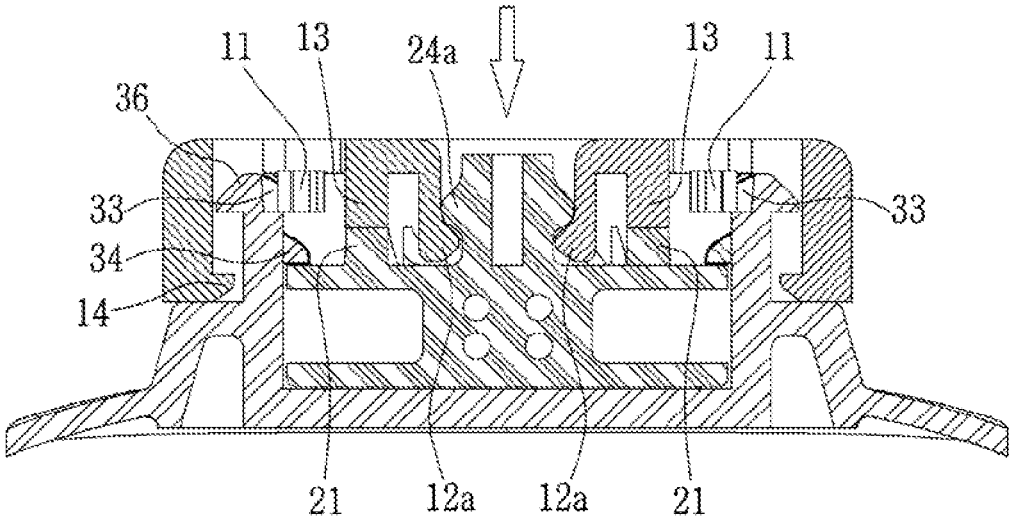

[FIG. 9]
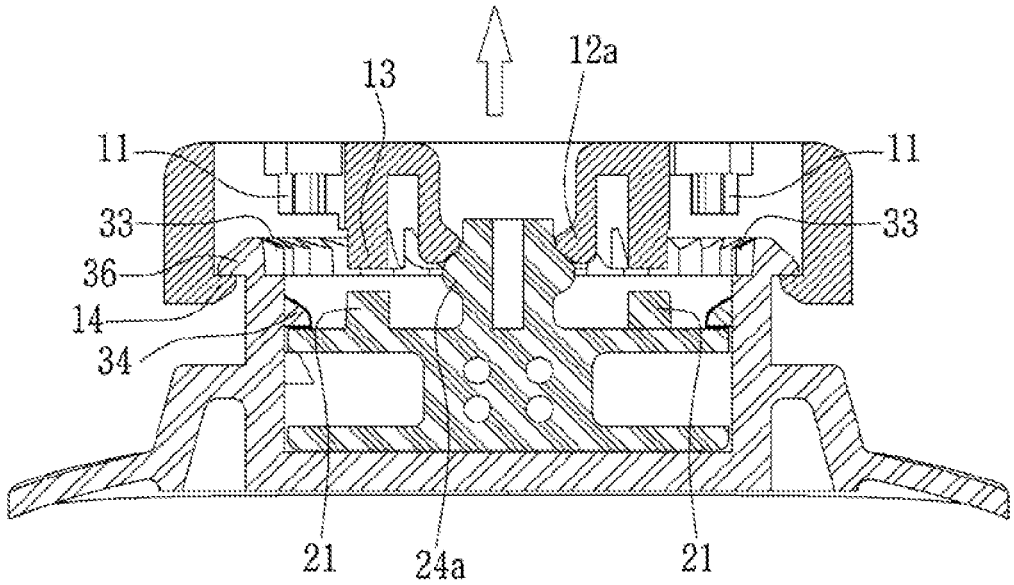
[FIG. 10]
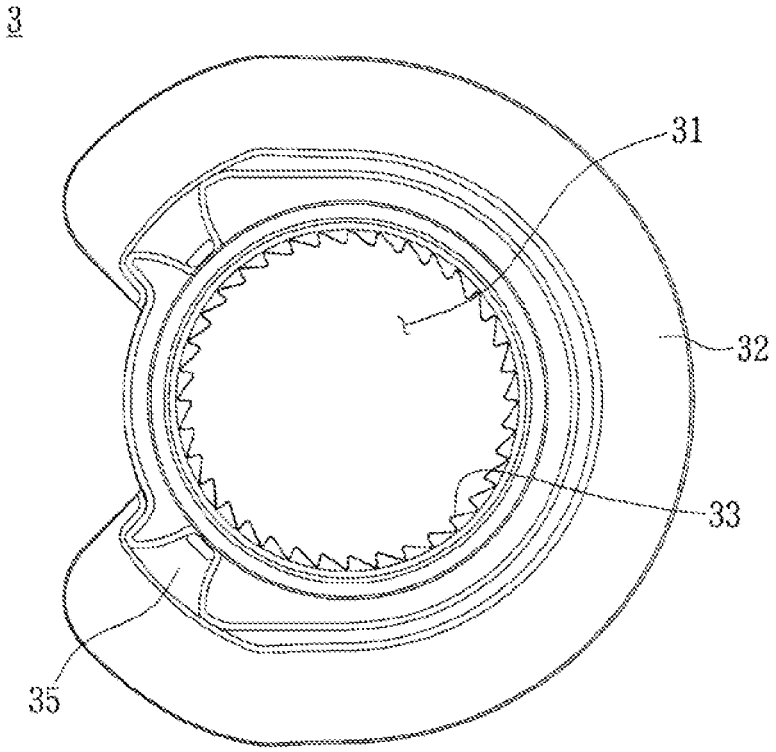

[FIG. 11]
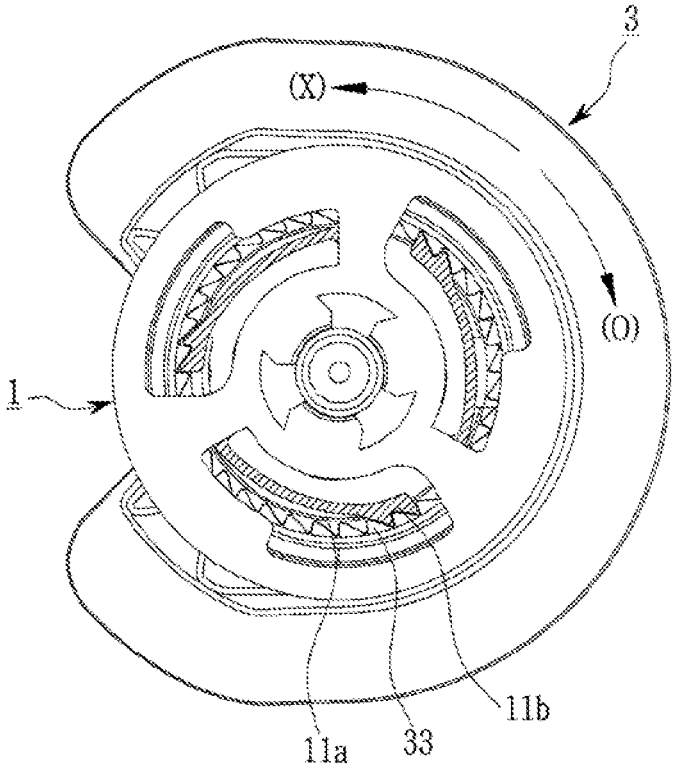
[FIG. 12]
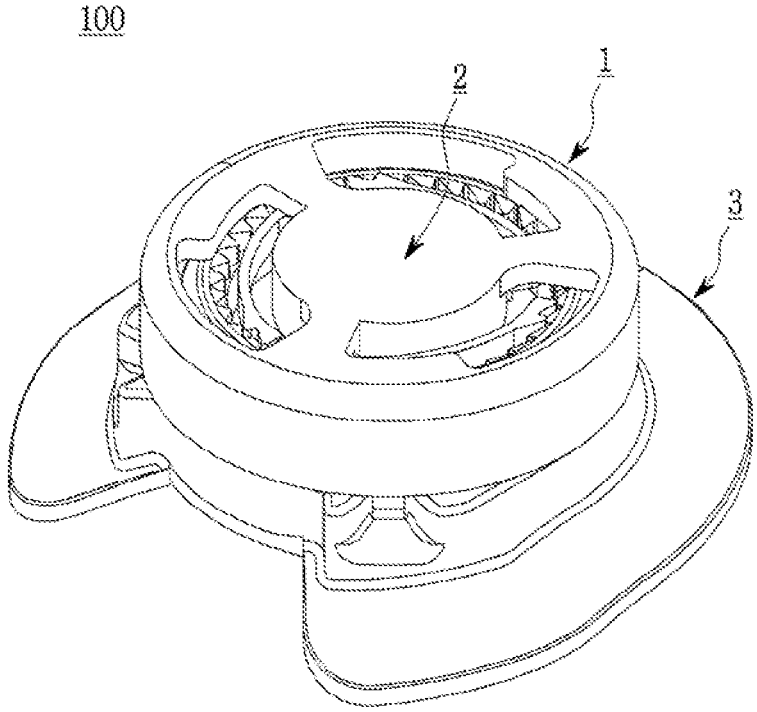

[FIG. 13]
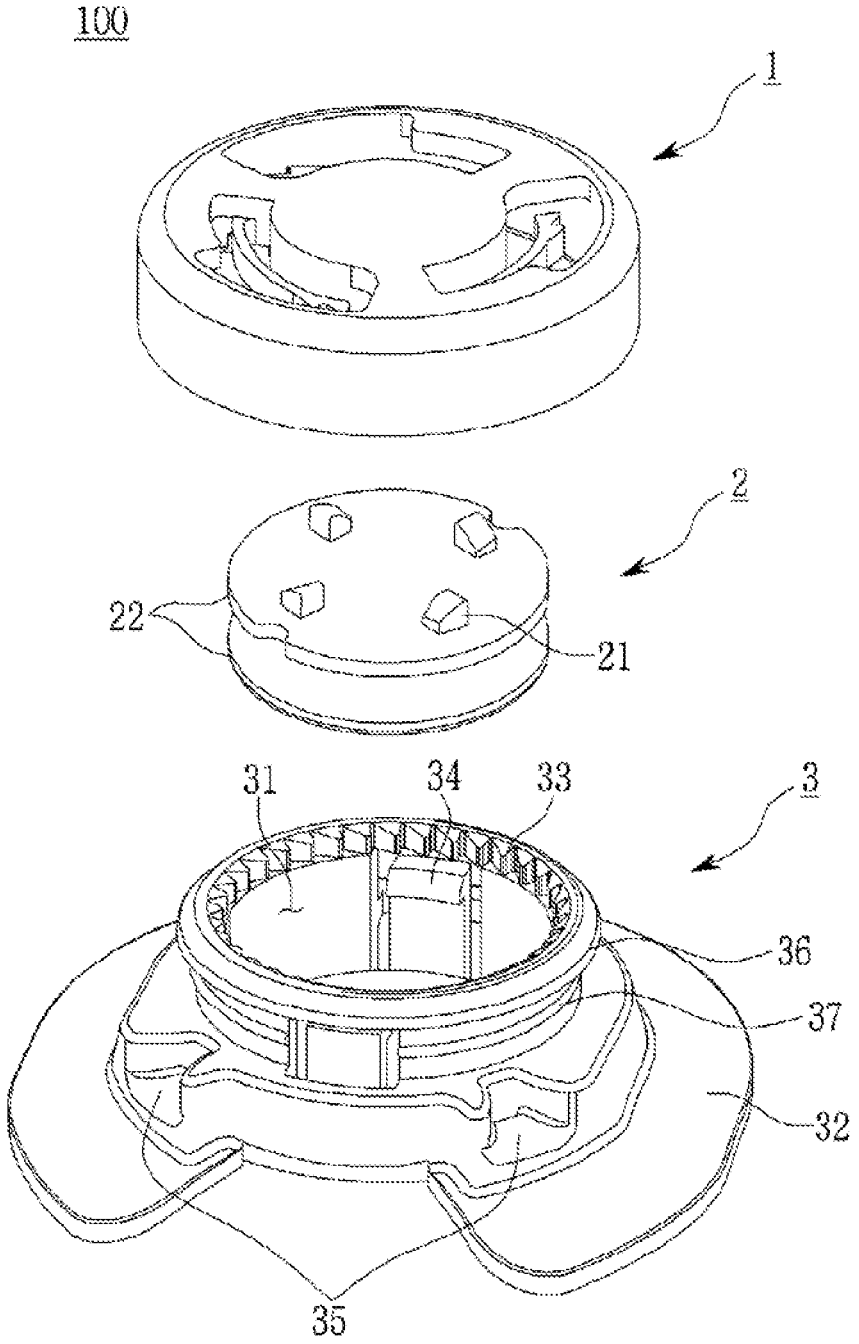

[FIG. 14]
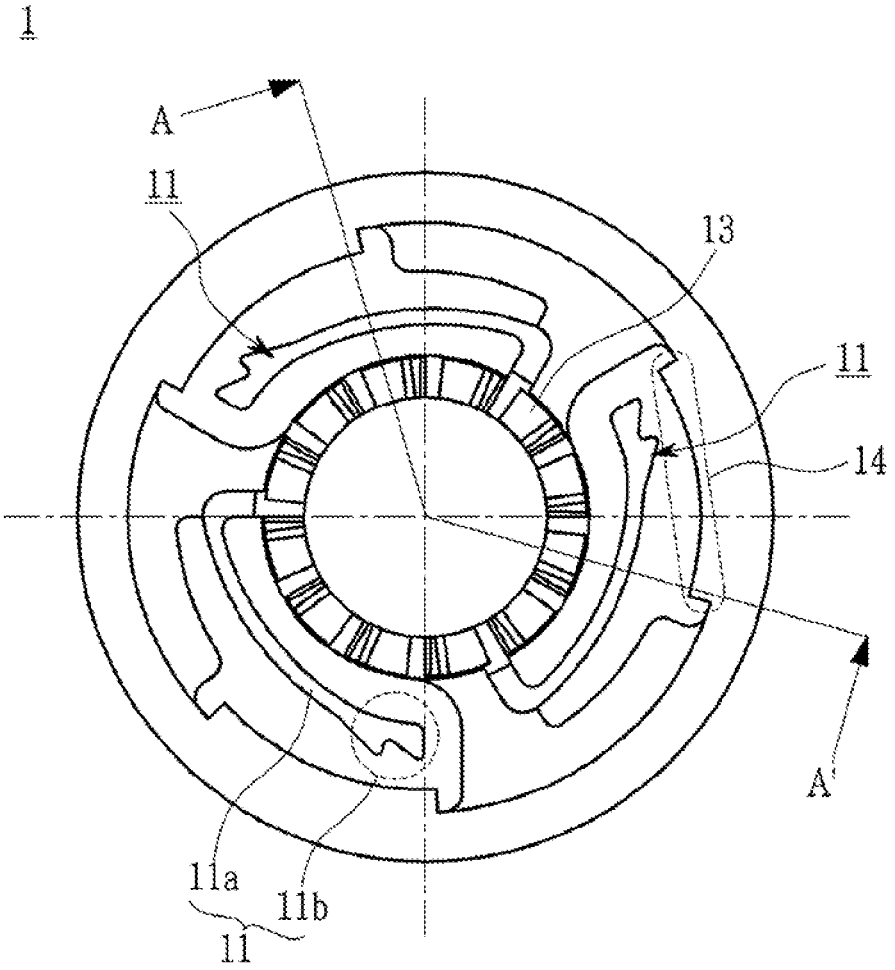
[FIG. 15]
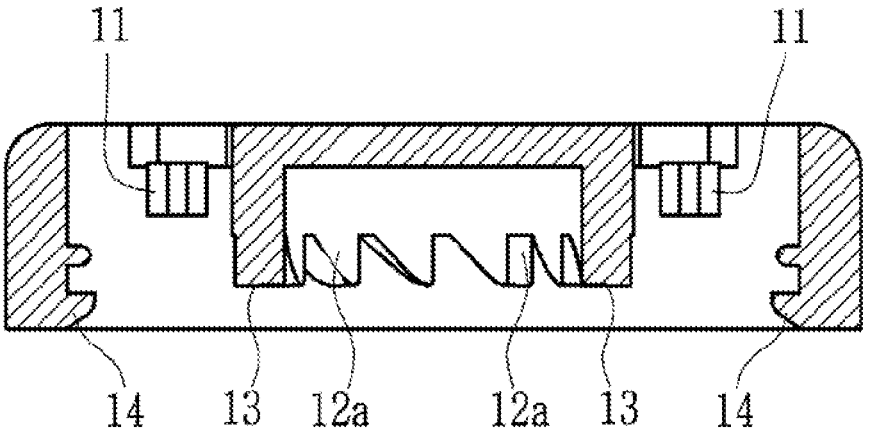

[FIG. 16]
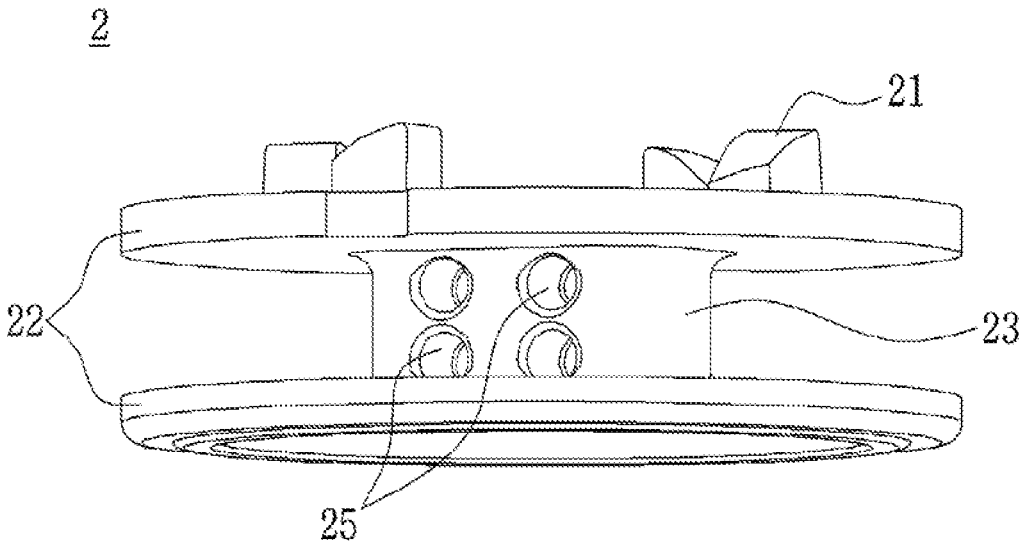
[FIG. 17]
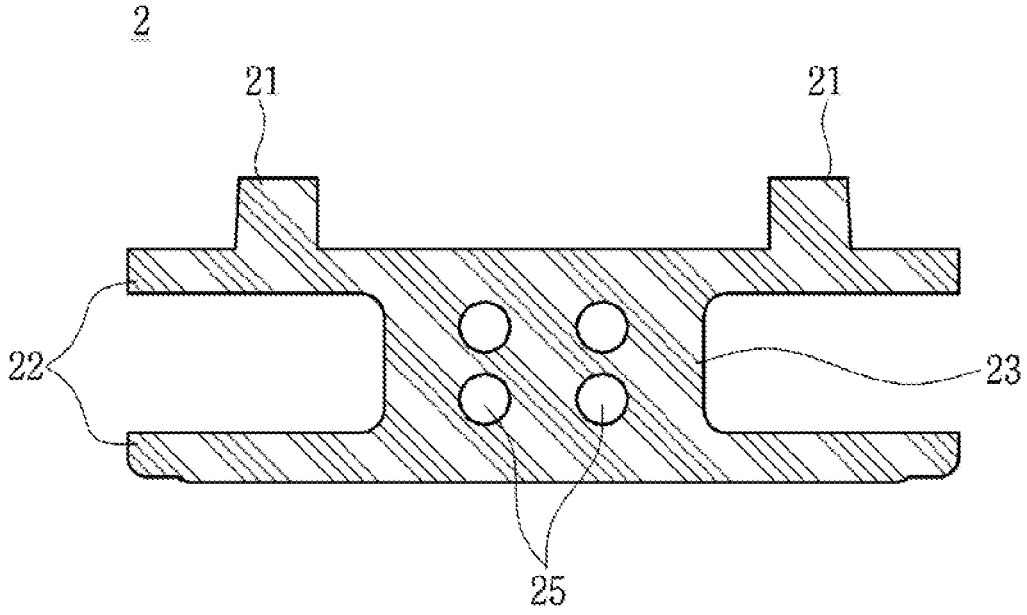

[FIG. 18]
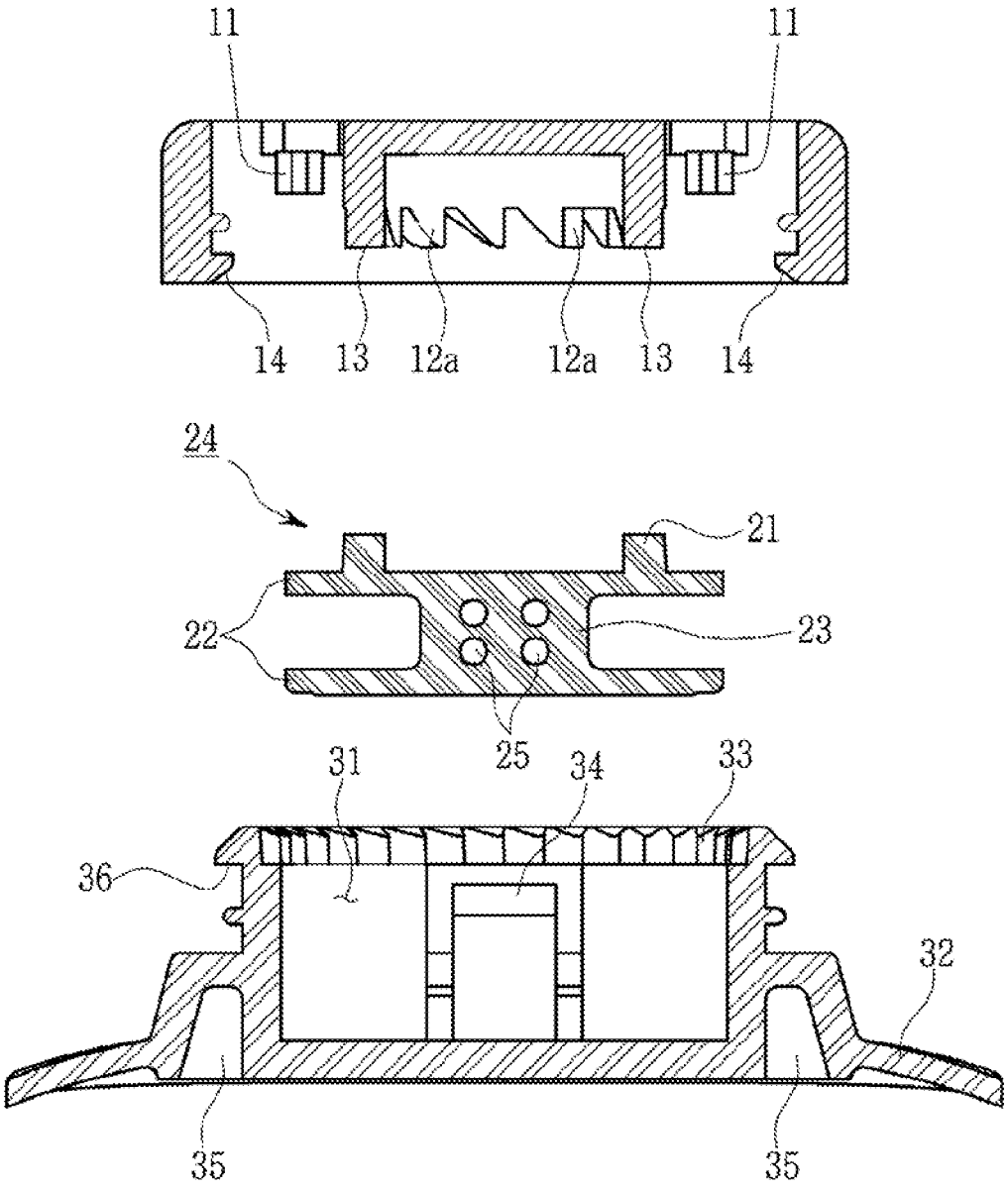

[FIG. 19]
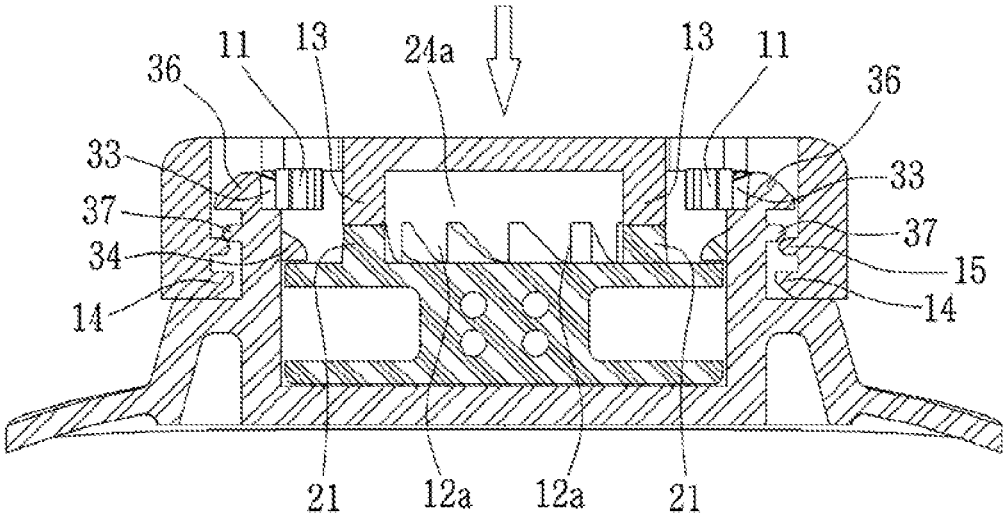
[FIG. 20]
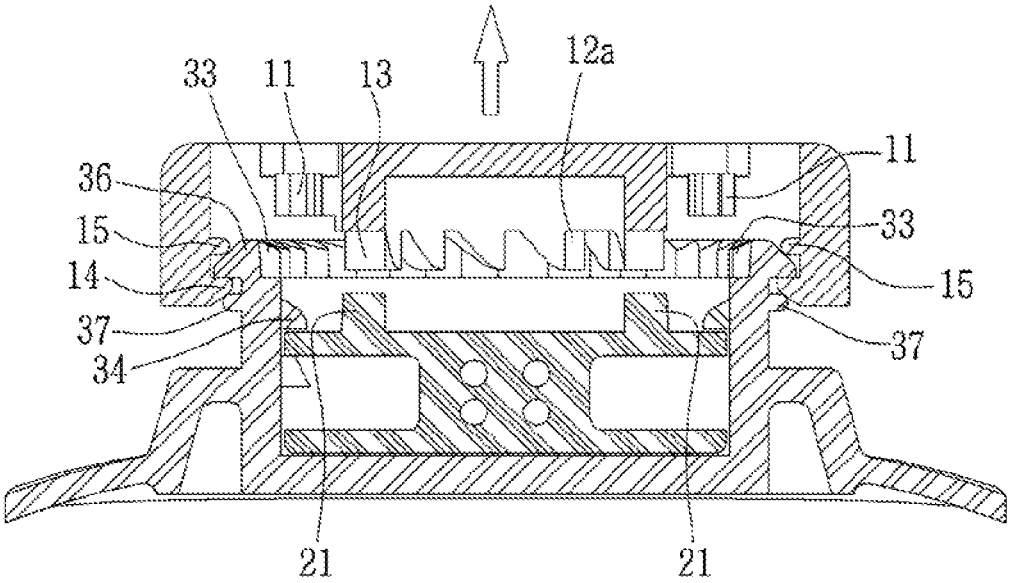

[FIG. 21]
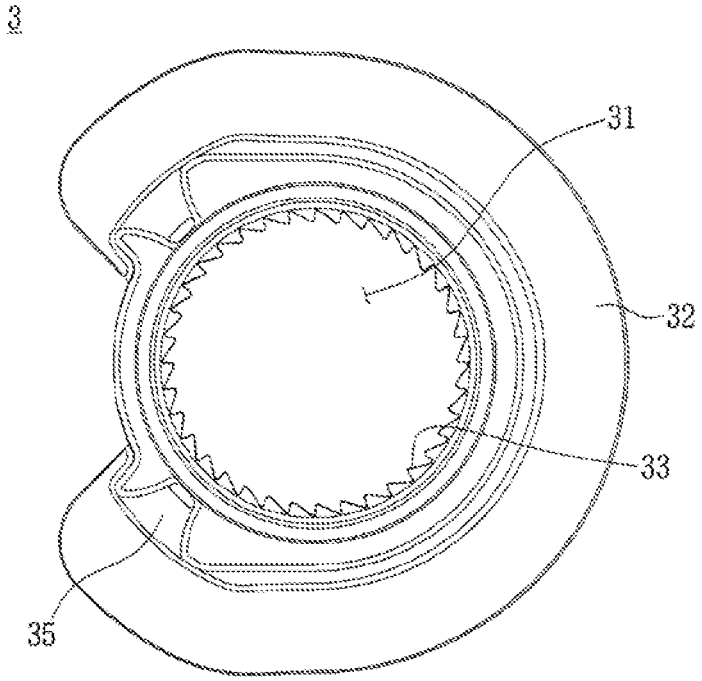
[FIG. 22]
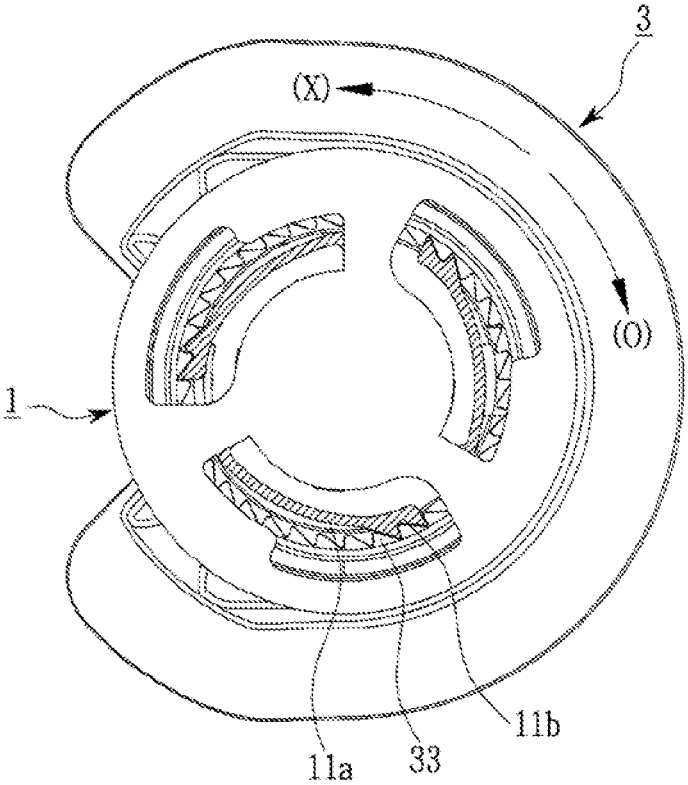

DEVICE FOR ADJUSTING LENGTH OF STRING

TECHNICAL FIELD

The present invention relates to a string length adjusting device capable of adjusting the length of strings provided in shoes or clothing, and more specifically, to an improved string length adjusting device, in which the number of components is reduced to lower unit costs and a failure rate, and assemblability of a product, and uniformity in quality and convenience of after service are improved.

BACKGROUND ART

Generally, adjusting bands (hereinafter, referred to as 'strings') configured to adjust a waist circumference or a head circumference according to a body of a wearer as necessary or after being worn is provided in shoes such as sneakers or the like, a bag, or clothing such as a sportswear, a hat, or the like, and the string generally includes a fixing clip moving along the string at an end thereof so that the length of the string is uniformly maintained.

For example, shoelaces configured so that shoes are suitable to feet of individuals are provided in shoes such as sneakers, and a wearer brings feet thereof into close contact with the shoes by appropriately pulling and fastening the shoelaces after wearing the shoes to safely and comfortably walk.

Meanwhile, releasing or re-tightening strings every time wearing articles such as shoes, clothing, sports equipment, or the like is very cumbersome, and string length adjusting devices configured to solve the cumbersomeness are developed and disclosed.

For example, a string length adjusting device including a fixing housing, a rotating housing, a winding drum, a free curved spring coupled to an upper portion of the rotating housing, and a coupling member (bolt) configured to couple the fixing housing and the rotating housing is disclosed in Korean Patent No. 959800 (published in May 28, 2010).

Further, a string length adjusting device including a fixing housing, a rotating housing, a winding drum, a coupling unit (a shaft and a screw) configured to couple the fixing housing and the rotating housing, and a free curved-spring coupled to an upper portion of the rotating housing is disclosed in Korean Patent No. 1147681 (published in May 22, 2012), and a string length adjusting device including a fixing housing having a drum rotary shaft formed at a center thereof, a rotating housing coupled to the fixing housing, a winding drum, and a coupling unit guide shaft (a shaft and a fixing screw) configured to couple the fixing housing and the rotating housing and guide an up or down operation of the rotating housing for a winding or unwinding operation of a string is disclosed in Korean Patent No. 1107372 (published in Jan. 19, 2012).

However, since each of the above-described conventional string length adjusting devices requires a coupling member or the like configured to couple components in addition to the fixing housing, the rotating housing, and the winding drum, and should adopt a special-shaped spring configured to provide an elastic force, or the like as an essential configuration for an operation, manufacturing costs increase and a structure becomes complicated.

Further, a coupling member such as a bolt, a screw, or the like should be adopted to couple the components, and since uniformly maintaining fastening torque of the coupling member during an assembly process is not easy, not only assemblability, quality, and the like are not good, and providing after service is not easy, but also a failure caused by deformation or separation of a spring which is an essential component, abrasion of a coupling member fastening part, or the like can occur.

DISCLOSURE

Technical Problem

The present invention is directed to providing a string length adjusting device in which the number of components configured to implement a string length adjusting device is reduced and the device is simplified to reduce product costs and failure rates, and the components are press-fitted to each other without adopting a coupling member such as a bolt, a screw, or the like, or a spring to improve assemblability of a product, uniformity in quality, operation stability, and after service convenience.

Technical Solution

One aspect of the present invention provides a string length adjusting device including: a fixing housing having a cylindrical-shaped accommodation part, of which an upper portion is open, therein; a rotating housing rotatable with respect to the fixing housing and coupled to be vertically movable in an axial direction; and a winding drum inserted into the accommodation part and including a winding portion on which a string is wound or unwound, wherein a shaft configured to extend in an axial direction and branched to be elastically biased in a radial direction and a shaft coupling part to which the branched shaft is fit-coupled are provided in one of the rotating housing and the winding drum, and a protruding portion is formed on the branched shaft, a catching portion configured to support the protruding portion at a location in which the rotating housing moves upward or downward in an axial direction is formed in the shaft coupling part, and the protruding portion is fit-coupled to or fit-released from the catching portion while the rotating housing moves upward or downward in the axial direction.

Advantageous Effects

Since a string length adjusting device according to the present invention is simplified to be formed of only three components except for a string to be operable, operation stability is superior and production cost and failure rates can be reduced. Further, since the components can be press-fitted to each other without adopting a metal elastic member such as a screw, a coupling member such as a bolt, a nut, or the like, or a spring, deformation or separation of the spring, abrasion of a coupling member fastening part, or the like does not occur. Moreover, assemblability of a product and uniformity in quality are superior, and only a defective configuration can be press-released and easily replaced even in repair due to partial breakage or damage or the like, and thus after service is very easy.

That is, a method in which a shaft autonomously formed in the rotating housing of the present invention and a shaft coupling part of a winding drum are simply coupled to each other without a separate coupling member while a protruding portion formed in the shaft is engaged with a catching portion formed on the shaft coupling part is adopted and thus it is advantageous that replacement and repair are facilitated due to improvement in the ease of coupling.

According to another embodiment, the present invention can implement a method of more simply coupling a rotating housing and a fixing housing even without separately having a shaft and a shaft coupling part by configuring a tension protrusion part and a convex portion in the rotating housing and the fixing housing, respectively and allowing the rotating housing to receive tension while vertically moving with respect to the fixing housing.

DESCRIPTION OF DRAWINGS

FIG. 1 is a perspective view of a string length adjusting device according to the present invention.

FIG. 2 is an exploded perspective view of the string length adjusting device according to the present invention.

FIG. 3 is a bottom view of a rotating housing according to the present invention.

FIG. 4 is a cross-sectional view taken along line A-A' in FIG. 3.

FIGS. 5 and 6 are a side perspective view and a cut side-sectional view of a winding drum according to the present invention, respectively.

FIG. 7 is an exploded cross-sectional view of the string length adjusting device according to an embodiment of the present invention.

FIGS. 8 and 9 are coupled side-sectional views which exemplify an operation state of the string length adjusting device according to the present invention.

FIGS. 10 and 11 are coupled plan views showing an operation state of each of the rotating housing and a fixing housing according to the present invention.

FIGS. 12 to 22 are views illustrating a string length adjusting device according to another embodiment of the present invention along the style in the above-described embodiment.

BEST MODE

Further, the present invention provides a string length adjusting device including: a fixing housing having a cylindrical-shaped accommodation part, of which an upper portion is open, therein; a rotating housing rotatable with respect to the fixing housing and including a shaft configured to extend in an axial direction from a center thereof and branched to be elastically biased in a radial direction at a lower portion thereof, wherein a protruding portion is formed on the branched shaft; and a winding drum inserted into the accommodation part, including a winding portion on which a string is wound or unwound, and having a shaft coupling part formed at an upper portion thereof to extend upward in an axial direction from a center thereof so that the branched shaft is fit-coupled thereto and vertically moves in the axial direction, wherein a catching portion configured to support the protruding portion at a location in which the rotating housing moves downward in an axial direction is formed in the shaft coupling part, the protruding portion is located under the catching portion at the location in which the rotating housing moves downward in the axial direction, and the protruding portion is located on the catching portion at a location in which the rotating housing moves upward in the axial direction

Modes of the Invention

Hereinafter, preferable embodiments of the present invention will be described in detail by those skilled in the art with reference to the accompanying drawings. The present invention is not limited to following embodiments and may be implemented in various shapes, and contents not related to descriptions will be omitted to apparently describe the present invention.

First, a term 'string' which will be used below includes various "wires" or "strings" provided in shoes such as sports shoes, sports boots, or the like, bags, and clothing such as a sportswear, gloves, a hat, or the like, and is used to include 'wires' of earphones or a headset, and 'a charging cable,' 'a data cable,' or the like used in a smartphone or a computer.

FIG. 1 is a perspective view of a string length adjusting device according to the present invention, and FIG. 2 is an exploded perspective view of the string length adjusting device according to the present invention.

As shown in FIGS. 1 and 2, a string length adjusting device 100 according to an embodiment of the present invention may not include a coupling member such as a screw, a bolt, a nut, or the like, or an elastic member such as a spring or the like, and may be formed of only three components, that is, only a rotating housing 1, a winding drum 2, and a fixing housing 3 when excluding the string. Accordingly, the string length adjusting device 100 may have a simplified structure in comparison with a conventional string length adjusting device and thus product costs and a failure rate may be reduced and assemblability of a product and uniformity in quality are superior, and after service is very easy even when partial breakage or damage or the like occurs.

The fixing housing 3 has a cylindrical-shaped accommodation part 31, of which an upper portion is open, therein, and includes a an approximately plate-shaped flange 32 to attach and fix the string length adjusting device 100 to an object to be attached such as a shoe or the like, at a low portion thereof. The fixing housing 3 may be fixed by locating a lower surface of the flange 32 so that the lower surface of the flange 32 comes into contact with the object to be attached such as a shoe, a bag, or the like.

Two string through holes 35 through which a string (not shown) may be withdrawn to the outside of the fixing housing 3 from the accommodation part 31 may be formed to be spaced apart from each other in side surfaces of the fixing housing 3.

Sawteeth 33 processed in a shape allowing rotation of the rotating housing 1 in only one direction when engaged with a latch 11 of the rotating housing 1 which will be described below may be provided at an upper portion of the fixing housing 3 (see FIGS. 10 and 11). Here 'one direction' means one direction of a clockwise direction or a counterclockwise direction, and will be the same hereinafter.

As shown in FIGS. 1 and 2, the sawteeth 33 may be formed on an upper inner circumferential surface of the fixing housing 3, that is, an upper inner circumferential surface of the accommodation part 31, but the position of the sawteeth 33 is not limited thereto, and the sawteeth 33 may be formed on an upper outer circumferential surface or an upper end portion of the fixing housing 3.

Flow prevention protrusions 34 formed to extend inwardly in a radial direction along an inner circumferential surface of the fixing housing 3 are formed under the sawteeth 33 of the fixing housing 3, and serve to prevent separation of the winding drum 2 which is inserted to the accommodation part 31, from the accommodation part 31.

In the above, although the flow prevention protrusion 34 are formed at both sides in the fixing housing 3, in consideration that winding drum 2 should be easily separated from the accommodation part 31 when repaired, and the fixing housing 3 becomes fragile and probability of breakage increases when two flow prevention protrusions 34 are provided, the flow prevention protrusion 34 may be provided at only one side in the fixing housing 3.

When the string length adjusting device 100 includes only the rotating housing 1, the winding drum 2, and the fixing housing 3, the flow prevention protrusion 34 may be formed to have a characteristic which can be curved by an external force, and restored to an original shape when the external force is removed, that is, flexibility to insert the winding drum 2 into the accommodation part 31 or remove the winding drum 2 from the accommodation part 31 when the device is assembled or disassembled.

Accordingly, when the winding drum 2 is inserted into the accommodation part 31 from an upper side, the flow prevention protrusion 34 having flexibility may be curved vertically or laterally to be deformed, and the winding drum 2 may be inserted into and seated in the accommodation part 31 through a gap formed by deformation of the flow prevention protrusion 34, and after the winding drum 2 is seated in the accommodation part 31, the flow prevention protrusion 34 is restored to the original state to serve to prevent the separation of the winding drum 2 from the accommodation part 31.

The fixing housing 3 may be integrally formed, but also be formed by press-fitting two separated configurations, that is, a body part and a base.

The body part may have a cylindrical shape having opened upper and lower portions to have the accommodation part 31, and the two string through holes 35 through which the string may be withdrawn to the outside from the accommodation part 31 may be formed to be spaced apart from each other in a side surface of the body part.

The base is provided to be attached and fixed to the object to be attached such as a shoe or the like, and provided with the approximately plate-shaped flange 32.

The body part and the base may be configured to be press-fitted to each other.

If the fixing housing 3 is formed by press-fitting two separated configurations, that is, the body part and the base, particularly when repair is necessary, since the remaining components except the base fixed to the object to be attached such as a shoe, a bag, or the like may be separated from the base and then may be coupled to the base again after replacing only damaged or defective components, maintenance and after service are very convenient.

FIG. 3 is a bottom view of a rotating housing according to the present invention. FIG. 4 is a cross-sectional view taken along line A-A' in FIG. 3. FIGS. 5 and 6 are a side perspective view and a cut side-sectional view of a winding drum according to the present invention, respectively. FIG. 7 is an exploded cross-sectional view of the string length adjusting device according to an embodiment of the present invention. FIGS. 8 and 9 are coupled side-sectional views which exemplify an operation state of the string length adjusting device according to the present invention. FIGS. 10 and 11 are coupled plan views of an operation state of each of the rotating housing and the fixing housing according to the present invention.

Referring to FIG. 7, separation prevention protrusions 36 formed to extend to the outside are provided on an upper outer circumferential surface of an upper end of the fixing housing 3, and serve to prevent separation of the following rotating housing 1 coupled to the fixing housing 3 from the fixing housing 3.

The rotating housing 1 serves as a handle when the string is wound, and is coupled to the fixing housing 3 to be rotatable with respect to the fixing housing 3 and vertically movable in an axial direction.

The rotating housing 1 has an approximate disk shape having a space formed in a lower portion thereof, and is provided with a shaft 12, housing coupling sawteeth 13, and the latch 11 at the lower portion thereof. The shaft 12 is provided in a shape extending in an axial direction from a lower center of the rotating housing 1, and has a structure that is branched and may be elastically biased inward or outward in a radial direction.

As shown in FIG. 4, the shaft 12 may be branched into two shafts but is not limited thereto, and may be branched in to three or more, and preferably, the shaft 12 is branched into two to four.

Further, as shown in the drawings, the shaft 12 may be formed in a completely separated shape but is not limited thereto, and may also be formed in a shape branched into two or more while extending downward in the axial direction.

Protruding portions 12*a* configured to protrude inward in the radial direction may be formed in the branched shafts 12 which may be elastically biased inward or outward in the radial direction.

The protruding portions 12*a* are provided to interact with catching portions 24*a* formed on an inner circumferential surface of an insertion hole 24 of the winding drum 2 which will be described below, and serve to allow the rotating housing 1 to maintain a state thereof by an elastic force at a location in which the rotating housing 1 moves upward or downward in an axial direction.

The housing coupling sawteeth 13 interact corresponding to drum coupling sawteeth 21 of the winding drum 2 which will be described below, and are formed in a shape in which a plurality of sawteeth form a circle around a circumference thereof with respect to the shaft 12.

A plurality of latches 11 which may be elastically biased inward or outward in a radial direction are provided at the outside of the housing coupling sawteeth 13. As shown in FIG. 2, the latches 11 are formed of a latch arm 11*a* having an approximately arc shape and extending in the form of a band and a stop tooth portion 11*b* formed on an end portion of the latch arm 11*a* in a sawtooth shape. The sawtooth shape of the stop tooth portion 11*b* is processed in a shape capable of rotating in only one direction to correspond to the shape of the sawteeth 33.

The latch arm 11*a* may have a predetermined length and a predetermined thickness to be appropriately elastically biased inward or outward in a radial direction of the rotating housing 1.

The stop tooth portion 11*b* is a portion that engages with and interacts with the sawteeth 33 formed in the fixing housing 3. The stop tooth portion 11*b* of the latch 11 is engaged with the sawteeth 33 at a location in which the rotating housing 1 moves downward in the axial direction. In this state, when the rotating housing 1 is rotated in one direction, the latch arm 11*a* is elastically biased inward in the radial direction and thus the stop tooth portion 11*b* moves to an adjacent sawteeth 33 by moving over the sawteeth 33, and the rotating housing 1 may continuously rotate in the above-described manner (see FIGS. 10 and 11).

On the other hand, when the rotating housing 1 is desired to be rotated in an opposite direction, since the stop tooth portion 11*b* is completely engaged with the sawteeth 33 and thus may not move over the sawteeth 33, the rotating housing 1 may not rotate (see FIGS. 10 and 11). That is, as shown in FIG. 8, the rotating housing 1 becomes to be rotatable in only one direction at the location in which the rotating housing 1 moves downward in the axial direction due to interaction between the latch 11 and the sawteeth 33 having a shape capable of rotating in only one direction.

Meanwhile, the latch 11 may also be provided in a shape which may be elastically biased upward in the axial direction, and in this case, the coupling sawteeth 33 corresponding to the latch 11 may be disposed at an upper end portion of the fixing housing 3.

In the present invention, an example in which three latches 11 are provided in the rotating housing 1 is shown, but the present invention is not limited thereto, and the number of latches 11 may decrease or increase as necessary.

An edge of the rotating housing 1 having a disk shape extends in a downward direction to form a space at a lower portion, and a portion of an extended end portion extends inward in the radial direction by a predetermined length to form a coupling protrusion 14. The shape and structure of the coupling protrusion 14 are exemplified in FIG. 4, but the shape, the structure and the number thereof are not limited thereto.

The coupling protrusion 14 is provided to interact with the separation prevention protrusion 36 formed to protrude outwaed from the upper outer circumferential surface of the fixing housing 3, and serves to prevent separation of the rotating housing 1 coupled to the fixing housing 3 from the fixing housing 3 when the rotating housing 1 moves upward in the axial direction (see FIG. 9).

The winding drum 2 is provided to be rotatably inserted into the accommodation part 31 of the fixing housing 3, and includes a winding portion 23 on which a string is wound or unwound by rotation.

A shaft coupling part 24 configured to extend upward in the axial direction from the center of the winding drum 2 is formed on the winding drum 2, and accordingly, the winding drum 2 may rotate in a forward direction or a reverse direction with the shaft 12 as a rotary shaft.

A catching portion 24*a* configured to support the protruding portions 12*a* formed in the shaft 12 at the location in which the rotating housing 1 moves upward or downward in the axial direction is formed on an outer circumferential surface of the shaft coupling part 24, and a case shown in FIG. 2 shows the catching portion 24*a* in a shape protruding outward in a diameter direction from the outer circumferential surface of the shaft coupling part 24 as an embodiment, but is not limited thereto.

String fixing holes 25 configured to bind and fix an end portion of the string to the winding drum 2 are formed in the winding portion 23. Further, two (a pair of) disk-shaped disk portions 22 configured to prevent the spring which is wound from arbitrarily moving upward or downward with respect to the winding portion 23 so that the string may be evenly wound on the winding portion 23 or orderly unwound from the winding portion 23 are formed in the winding drum 2 to be spaced apart from each other with the winding portion 23 interposed therebetween.

Meanwhile, as shown in FIGS. 8 and 9, an outer end portion of the disk portion 22 located on an upper side of the two (the pair of) disk portions 22 in a diameter direction is prevented from being separated from the accommodation part 31 by the flow prevention protrusion 34 formed to protrude inward in the radial direction along the inner circumferential surface of the accommodation part 31 of the fixing housing 3.

That is, the disk portion 22 may rotate on the accommodation part 31 without flowing in an upward direction due to the flow prevention protrusion 34, and the winding drum 2 may maintain an original position even when the rotating housing 1 moves upward in the axial direction.

The drum coupling sawteeth 21 configured to interact corresponding to the housing coupling sawteeth 13 are formed on an upper surface of the winding drum 2, and a plurality of drum coupling sawteeth 21 are formed in a shape forming a circle around the upper disk portion 22 of the winding drum 2.

FIG. 8 is a coupled side-sectional view illustrating the location in which the rotating housing 1 moves downward in the axial direction, that is, a state for winding the string on the winding drum 2, and FIG. 9 is a coupled side-sectional view illustrating the location in which the rotating housing 1 moves upward in the axial direction, that is, a state for unwinding the string from the winding drum 2.

First, as shown in FIG. 8, in the location in which the rotating housing 1 moves downward in the axial direction, the latch 11 is engaged with the sawteeth 33 and thus the rotating housing 1 becomes rotatable in only one direction, and at the same time, the housing coupling sawteeth 13 are engaged with the drum coupling sawteeth 21, and the protruding portion 12*a* is located under the catching portion 24*a*. In this state, a user may wind the string on the winding drum 2 by rotating the rotating housing 1 in one direction.

As shown in FIG. 9, in the location in which the rotating housing 1 moves upward in the axial direction, the latch 11 and the housing coupling sawteeth 13 are spaced apart from the sawteeth 33 and the drum coupling sawteeth, respectively, and the protruding portion 12*a* is located on the catching portion 24*a*. In this state, since the winding drum 2 is not limited in rotation, the user may unwind the string from the winding drum 2 by pulling the string.

Meanwhile, since the winding drum 2 is not limited in the rotation when the housing coupling sawteeth 13 are spaced apart from the drum coupling sawteeth 21 at the location in which the rotating housing 1 moves upward in the axial direction, the user may unwind the string from the winding drum 2 by pulling the string. Accordingly, unlike the example of FIG. 9, the latch 11 does not have to be spaced apart from the sawteeth 33 at the location in which the rotating housing 1 moves upward in the axial direction, and the latch 11 and the sawteeth 33 may maintain a state of being engaged with each other even when the housing coupling sawteeth 13 are spaced apart from the drum coupling sawteeth 21.

Since the shaft 12 has a structure of being branched into a plurality of pieces and elastically biased inward or outward in the radial direction, a phenomenon in which a position of the protruding portion 12*a* is arbitrarily released in a state of being located under or on the catching portion 24*a* may be prevented.

FIGS. 12 to 22 are views illustrating a string length adjusting device according to another embodiment of the present invention along the style in the above-described embodiment.

As described above, the string length adjusting device may be formed of only three components, that is, a rotating housing 1, a winding drum 2, and a fixing housing 3 like the above embodiment.

Descriptions of configurations the same as those in the above-described embodiment will be omitted, and only characteristics of the embodiment will be described.

On a side surface of the fixing housing 3, in the drawings, a convex portion 37 is formed under a separation prevention protrusion 36 on an outer side surface of the fixing housing 3. The convex portion 37 may be formed to have a characteristic which can be curved by an external force and restored to an original shape when the external force is removed, that is, flexibility, but may be fixed without the flexibility.

Further, the convex portion 37 may be formed in a continuous shape surrounding the outer side surface of the fixing housing 3 in a circular shape, but a plurality of convex portions 37 may be formed on the outer side surface of the fixing housing 3, and the shape, the structure, and the number of the convex portions 37 are not limited to the above.

The rotating housing 1 is provided to serve as a handle when a string is wound, is rotatable with respect to the fixing housing 3, and is coupled to be vertically movable with respect to the fixing housing 3.

The rotating housing 1 has an approximate disk shape having a space formed in a lower portion thereof, and is provided with housing coupling sawteeth 13 and a latch 11 at the lower portion thereof A tension protrusion part 15 is configured on an inner side surface of the rotating housing 1, and the tension protrusion part 15 may be formed to have a characteristic which can be curved by an external force and restored to an original shape when the external force is removed, that is, flexibility As described above, although an example, in which the shape and structure of the tension protrusion part 15 configured on the inner side surface of the rotating housing 1 include a plurality of tension protrusion parts 15 configured on the inner side surface of the rotating housing 1, is described, the shape, the structure, and the number of the tension protrusion parts 15 are not limited to the above, and the tension protrusion part 15 includes a structure capable of generating tension.

That is, since the convex portion 37 is formed on the outer side surface of the fixing housing 3, and the tension protrusion part 15 having an elastic force is formed on the inner side surface of the rotating housing 1, when the rotating housing 1 vertically moves with respect to the fixing housing 3, the tension protrusion part 15 is configured to come into contact with the convex portion 37 and provide an elastic force during vertical movement of the rotating housing 1.

The winding drum 2 is provided to be rotatably inserted into an accommodation part 31 of the fixing housing 3, and includes a winding portion 23 on which the string is wound or unwound by rotation.

String fixing holes 25 configured to bind and fix an end portion of the string to the winding drum 2 are formed in the winding portion 23. Further, two (a pair of) disk-shaped disk portions 22 configured to prevent the spring which is wound from arbitrarily moving vertically with respect to the winding portion 23 so that the string may be evenly wound on the winding portion 23 or orderly unwound from the winding portion 23 are formed in the winding drum 2 to be spaced apart from each other with the winding portion 23 interposed therebetween.

Meanwhile, as shown in FIGS. 19 and 20, an outer end portion of the disk portion 22 located on an upper side of the two (the pair of) disk portions 22 in a diameter direction is prevented from being separated from the accommodation part 31 by the flow prevention protrusion 34 formed to protrude inward in the radial direction along the inner circumferential surface of the accommodation part 31 of the fixing housing 3.

That is, the disk portion 22 may rotate on the accommodation part 31 without flowing in an upward direction due to the flow prevention protrusion 34, and the winding drum 2 may maintain an original position even when the rotating housing 1 moves upward in an axial direction.

Drum coupling sawteeth 21 configured to interact by corresponding to the housing coupling sawteeth 13 are formed on an upper surface of the winding drum 2, and a plurality of drum coupling sawteeth 21 are formed in a shape forming a circle around the upper disk portion 22 of the winding drum 2.

FIGS. 19 and 20 are coupled side-sectional views which exemplify an operation state of the string length adjusting device according to another embodiment of the present invention.

FIG. 19 is a coupled side-sectional view illustrating the location in which the rotating housing 1 moves downward in the axial direction, that is, a state for winding the string on the winding drum 2, and FIG. 20 is a coupled side-sectional view illustrating the location in which the rotating housing 1 moves upward in the axial direction, that is, a state for unwinding the string from the winding drum 2.

First, as shown in FIG. 19, in the location in which the rotating housing 1 moves downward in the axial direction, the latch 11 is engaged with the sawteeth 33 and thus the rotating housing 1 becomes rotatable in only one direction, and at the same time, the housing coupling sawteeth 13 are engaged with the drum coupling sawteeth 21, and the tension protrusion part 15 of the rotating housing is located under the convex portion 37 of the fixing housing. In this state, a user may wind the string on the winding drum 2 by rotating the rotating housing 1 in one direction.

As shown in FIG. 20, in the location in which the rotating housing 1 moves upward in the axial direction, the latch 11 and the housing coupling sawteeth 13 are spaced apart from the sawteeth 33 and the drum coupling sawteeth, respectively, and the tension protrusion part 15 of the rotating housing is located on the convex portion 37 of the fixing housing. In this state, since the winding drum 2 is not limited in rotation, the user may unwind the string from the winding drum 2 by pulling the string.

Meanwhile, since the winding drum 2 is not limited in the rotation when the housing coupling sawteeth 13 are spaced apart from the drum coupling sawteeth 21 at the location in which the rotating housing 1 moves upward in the axial direction with respect to the fixing housing, the user may unwind the string from the winding drum 2 by pulling the string. Accordingly, unlike the example of FIG. 20, the latch 11 does not have to be spaced apart from the sawteeth 33 at the location in which the rotating housing 1 moves upward in the axial direction, and the latch 11 and the sawteeth 33 may maintain a state of being engaged with each other even when the housing coupling sawteeth 13 are spaced apart from the drum coupling sawteeth 21.

As described above, although some embodiments of the present invention are described, it is apparent that those skilled in the art may modify the embodiments without departing from the principle or the spirit of the present invention. Accordingly, the scope of the present invention is not limited to the disclosed embodiments, and may be variously changed and modified without departing from the spirit or the scope of the present invention, and changes and modifications should be within the scope of the present invention.

Industrial Applicability

The present invention relates to a string length adjusting device capable of adjusting the length of strings provided in shoes or clothing, and can be used in an industry of manufacturing shoes or the like

The invention claimed is:

1. A string length adjusting device, comprising:

a fixing housing having a cylindrical-shaped accommodation part, of which an upper portion is open, therein;

a rotating housing rotatable with respect to the fixing housing and coupled to be vertically movable in an axial direction, the rotating housing including a shaft configured to extend in the axial direction and branched to be elastically biased in a radial direction;

a winding drum inserted into the accommodation part and including a winding portion on which a string is wound or unwound and a shaft coupling part to which the shaft is fit-coupled; and a protruding portion is formed on the shaft, a catching portion configured to support the protruding portion at a location in which the rotating housing moves upward or downward in the axial direction is formed in the shaft coupling part, and the protruding portion is fit-coupled to or fit-released from the catching portion while the rotating housing moves upward or downward in the axial direction, wherein the fixing housing further includes at least one flow prevention protrusion formed on an inner circumference of the fixing housing to prevent the winding drum from leaving the accommodation part, wherein the winding drum further includes upper and lower disk portions, the upper and lower disk portions being spaced apart from each other with the winding portion interposed therebetween and being located between the flow prevention protrusion and a bottom of the accommodation part, wherein the shaft coupling part is formed on the upper disk portion.

2. The string length adjusting device of claim 1, wherein the rotating housing further includes at least one coupling protrusion formed on an inner circumference thereof and the fixing housing further includes at least one separation prevention protrusion formed on an outer circumference thereof to catch the coupling protrusion, thereby preventing separation of the rotating housing from the fixing housing while the protruding portion is fit-released from the catching portion.

3. A string length adjusting device comprising:

a fixing housing having a cylindrical-shaped accommodation part, of which an upper portion is open, therein;

a rotating housing rotatable with respect to the fixing housing and having a shaft configured to extend in an axial direction from a center thereof and branched to be elastically biased in a radial direction at a lower portion thereof, wherein a protruding portion is formed on the shaft; and a winding drum inserted into the accommodation part, including a winding portion on which a string is wound or unwound, and having a shaft coupling part formed at an upper portion thereof to extend upward in the axial direction from a center thereof so that the shaft is fit-coupled thereto and vertically moves in the axial direction, wherein a catching portion configured to support the protruding portion at a location in which the rotating housing moves downward in the axial direction is formed in the shaft coupling part, the protruding portion is located under the catching portion at the location in which the rotating housing moves downward in the axial direction, and the protruding portion is located on the catching portion at a location in which the rotating housing moves upward in the axial direction, wherein the fixing housing further includes at least one flow prevention protrusion formed on an inner circumference of the fixing housing to prevent the winding drum from leaving the accommodation part, wherein the winding drum further includes upper and lower disk portions, the upper and lower disk portions being spaced apart from each other with the winding portion interposed therebetween and being located between the flow prevention protrusion and a bottom of the accommodation part, wherein the shaft coupling part is formed on the upper disk portion.

4. The string length adjusting device of claim 3, wherein the rotating housing further includes at least one coupling protrusion formed on an inner circumference thereof and the fixing housing further includes at least one separation prevention protrusion formed on an outer circumference thereof to catch the coupling protrusion, thereby preventing separation of the rotating housing from the fixing housing while the protruding portion is fit-released from the catching portion.

* * * * *